United States Patent [19]

Jovanovic

[11] Patent Number: 5,029,413

[45] Date of Patent: Jul. 9, 1991

[54] VERTICAL WINDOW BLIND

[76] Inventor: Boban Jovanovic, 440 Magie Ave., Elizabeth, N.J. 07208

[21] Appl. No.: 488,173

[22] Filed: Mar. 5, 1990

[51] Int. Cl.[5] ..... E06B 7/096

[52] U.S. Cl. ..... 49/84; 49/74; 160/236

[58] Field of Search ..... 49/84, 74, 371; 160/236, 900

[56] References Cited

U.S. PATENT DOCUMENTS

| | | | |
|---|---|---|---|
| 1,582,129 | 4/1926 | Cornide | 49/84 |
| 2,074,482 | 3/1937 | Martens | 160/236 |
| 3,012,294 | 12/1961 | Waldor | 49/84 X |
| 4,195,680 | 4/1980 | Hyman et al. | 160/236 X |
| 4,425,955 | 1/1984 | Kaucic | 160/900 X |
| 4,628,980 | 12/1986 | Le Houillier | 160/236 X |
| 4,773,958 | 9/1988 | Goodman | 160/236 X |
| 4,899,491 | 2/1990 | Okumoto | 160/236 X |
| 4,911,220 | 3/1990 | Hiller | 160/236 |

*Primary Examiner*—Philip C. Kannan

*Attorney, Agent, or Firm*—Schweitzer, Cornman & Gross

[57] ABSTRACT

An improved window blind is formed of a plurality of vertical vanes each of which is formed of a transparent material. The vanes are pivotably mounted to a horizontal header and may be pivoted around their individual vertical axes. A design is affixed to the vanes by the incorporation of a multitude of individual colored glass-like elements, the overall arrangement of the elements creating a pre-selected design or pattern.

3 Claims, 3 Drawing Sheets

FIG. 1a
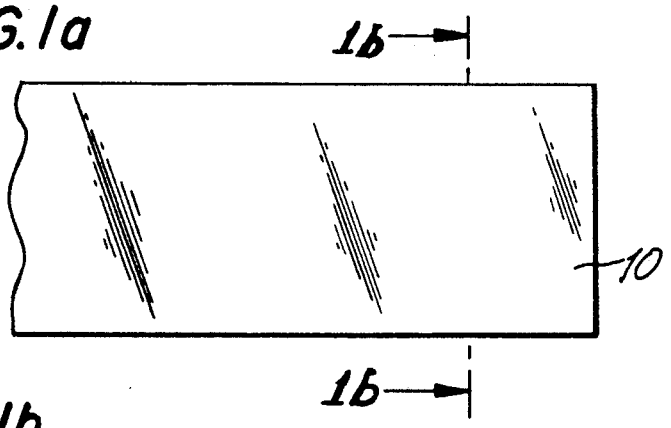
FIG. 1b
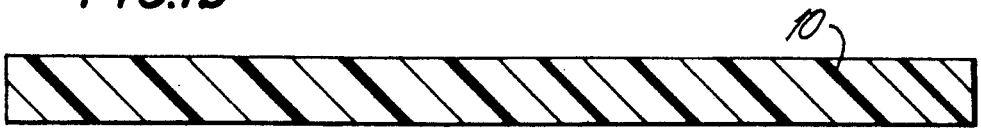
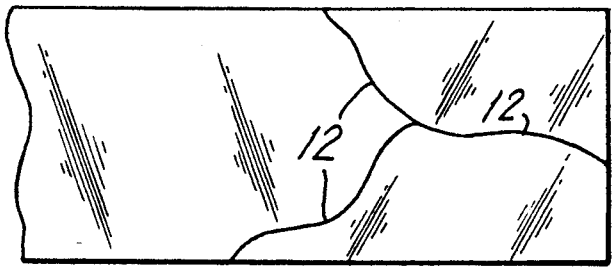
FIG. 2a
FIG. 3
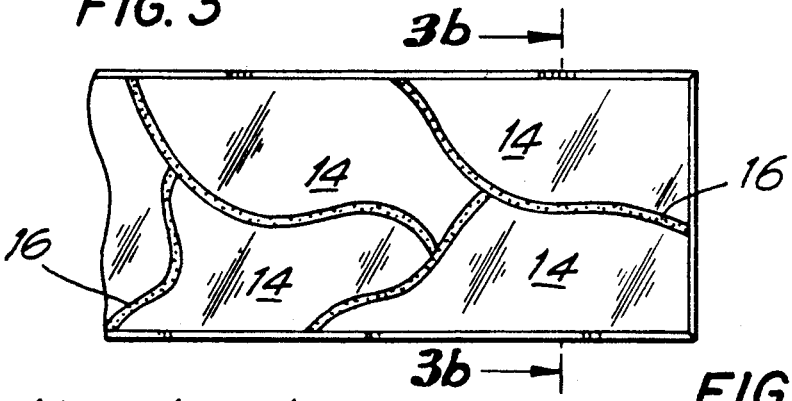
FIG. 3b
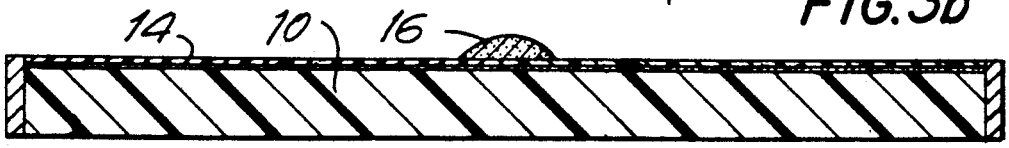

VERTICAL WINDOW BLIND

The present invention relates to a new and improved wall-hanging, window treatment and the like, and in particular, to a vertically oriented window blind which duplicates the look of a stained glass window and, when operated, can produce an enhanced, three-dimensional look or effect.

BACKGROUND OF THE INVENTION

The decorative arts and technologies disclose numerous forms of blinds, shades and the like adapted to be utilized in connection with windows to provide a variety of covering effects and textures. Typically, such devices utilize a plurality of slats or vanes arranged either horizontally or vertically and which are pivotable to control the amount of effective blockage created by the structure. The vanes are typically formed of an opaque substance, and are often decorated with a printed design, either applied directly to the vane material by a printing or embossing process, placed as a coating to the vanes, in the form of a sheet covering, such as a fabric or printed paper. In this manner the blind can be coordinated, for example, with the color scheme of the room or the wallpaper and/or fabrics utilized in connection therewith.

The general technology of the creation of "stained glass" panels is also well known, whereby the joining of individual colored elements, whether of glass or similar material, creates a composite panel of great luminance and color. The resulting decorative panels are typically utilized either as a structural element wherein the panel is permanently affixed within a wall, or as an ornamental object, where the panel is provided with an appropriate border and is mounted and displayed rather than as a functioning window element.

It is a purpose of the present invention to combine the stained glass technology and art with that related to the design and manufacture of window treatments so as to provide a window treatment which duplicates the look of a stained glass panel yet may further serve as an operable window blind.

It is further an object of the present invention to provide such a construction in a form which is easily manufactured, is of light weight, and may be efficiently utilized.

BRIEF SUMMARY OF THE INVENTION

In accordance with the above and further objects and purposes, the present invention comprises a plurality of panels or vanes, preferably oriented in a vertical alignment, upon each of which is mounted plastic elements simulating the elements of a traditional stained glass structure. The vanes themselves are mounted to a header in a fashion such that their overall orientation and presentation duplicates that of a composite stained glass panel. The individual vane members are each rotatable about a vertical axis, the members when so rotated out of a common plane creating three-dimensional effect for the simulated stained glass picture.

BRIEF DESCRIPTION OF THE DRAWINGS

A fuller understanding of the present invention will be obtained upon consideration of the following description of a detailed, but nonetheless illustrative embodiment of the invention when considered in conjunction with the annexed drawings, wherein:

FIG. 1*a* is a top plan view of a representative portion of a vane substrate;

FIG. 1*b* is an elevational section view taken along line 1*b*—1*b* of FIG. 1*a*;

FIG. 2 is a top plan view of the vane of FIG. 1 illustrating the application of layout lines for the applied colored segments;

FIG. 3*a* is a top plan view of the vane of FIG. 1 with the colored segments in place;

FIG. 3*b* is an elevational view taken along line 3*b*—3*b* of FIG. 3*a*;

DESCRIPTION OF A PREFERRED EMBODIMENT

Figure 4:
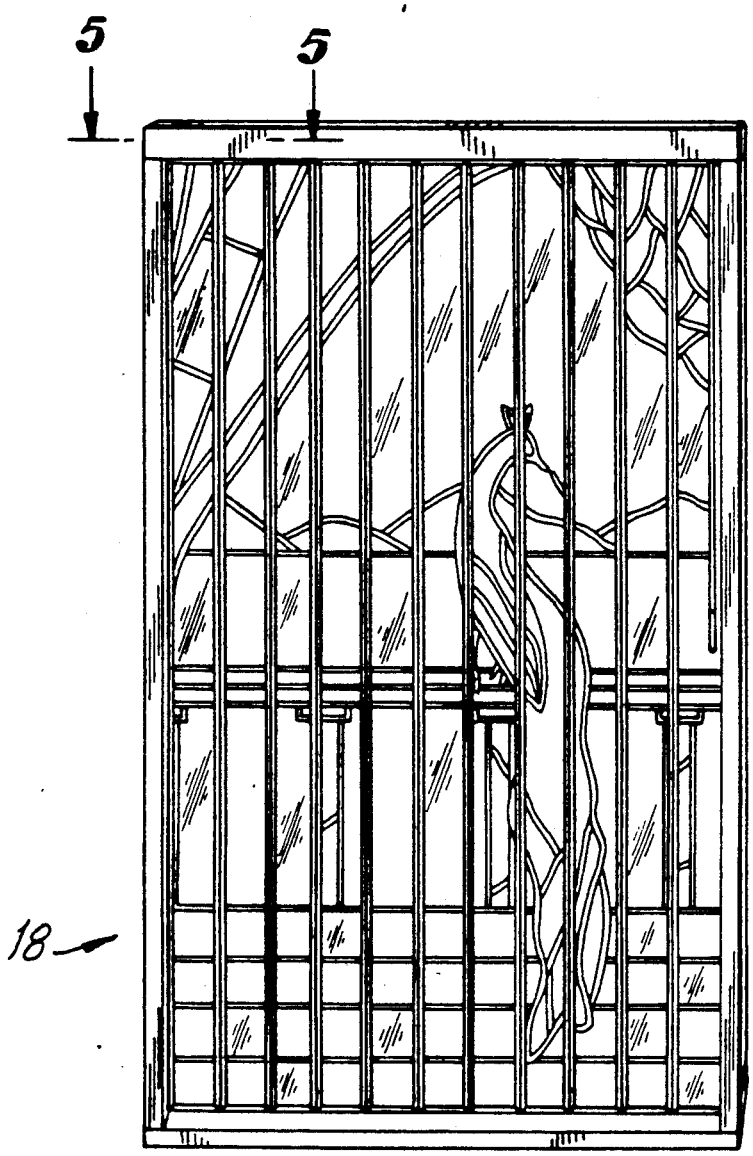
FIG. 4 is a front elevation view of a resulting window treatment of the present invention.

With reference to the Figures, a typical vane 10 for the window treatment of the present invention is of elongated rectangular form, formed of an appropriate substrate material, such as acrylic plastic. As shown in FIG. 2, the outline for the "stained glass" pattern to be applied to the substrate 12 is marked on the sheet through a series of lines 14. Individual colored panel elements 16, which are preferably of transparent, translucent or opalescent plastic to simulate glass elements, are then cut to the appropriate shape as indicated by the pattern lines 14, and are affixed to the substrate 12 by the use of an appropriate glue or adhesive. Lead beading 18, or a mastic-like compound simulating the look of lead beading as known in the art, is applied to the lines of intersection of the applied plastic elements 16 to further duplicate the stained glass look.

Each of the vanes 10 is covered with the appropriate portions of the desired pattern elements, thus creating a resulting overall design 20 as depicted in FIG. 4. As may be best seen in FIG. 6, each of the vanes 10 bearing the applied portion of the overall pattern 20 is suspended by a clip 22 mounted for rotation about a vertical axis in horizontally extending platform element 24 located in the header 26. Clip 22 is supported in a depending relationship with horizontal platform 22 by integral gear portion 28, which includes toothed gear element 30 and flange 32 which rests upon the top surface of the platform 24. The diameter of flange 32 is somewhat greater than the width of the clip 22, to allow the clip assembly to be dropped into a bore in the horizontal platform 24 and be supported thereupon by the flange 32.

The lower portion of the clip 22 is provided with a pair of parallel arms 34, 36 adapted to embrace the upper end of a vane 10 between them. The upper end of the vane 10 is provided with a throughbore 38 into which inwardly facing projection 40 on arm 34 projects to support the vane. An arm 36 having bulbous end 42, is flexed outwardly by the vane, and presses against the side of the vane retaining projection 40 within the throughbore 38 and maintaining the vane within the clip.

Figure 5:
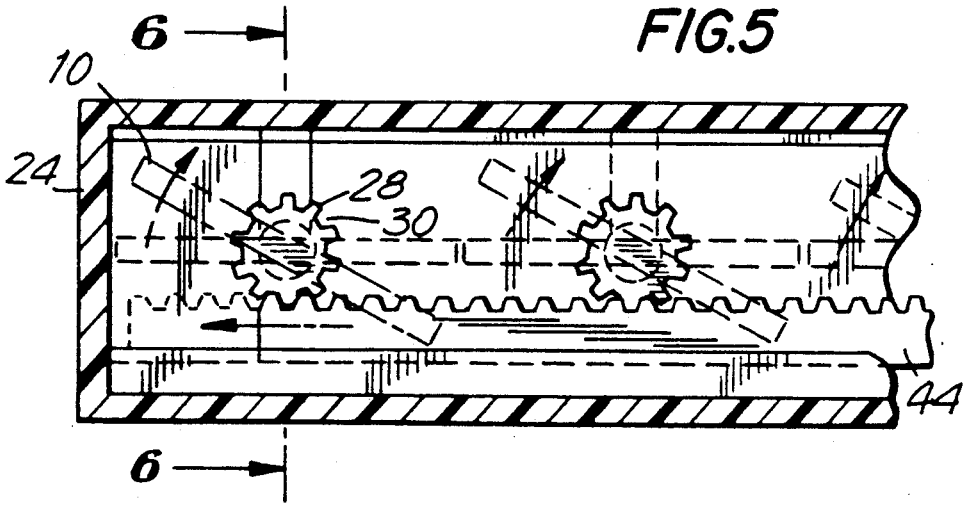
FIG. 5 is a plan section view taken along line 5—5 of FIG. 4 illustrating the pivot action of the vanes.
Figure 6:
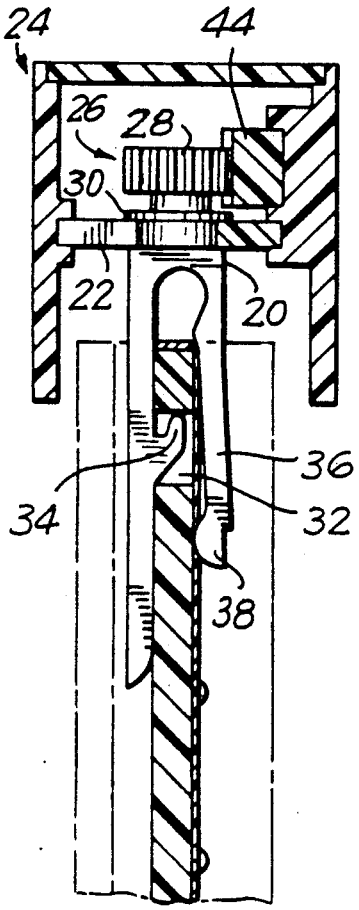
FIG. 6 is an elevational section view taken along line 6—6 of FIG. 5 further detailing the pivot mechanism and the means by which the individual vane elements are affixed to the pivot mechanism.
Figure 7:
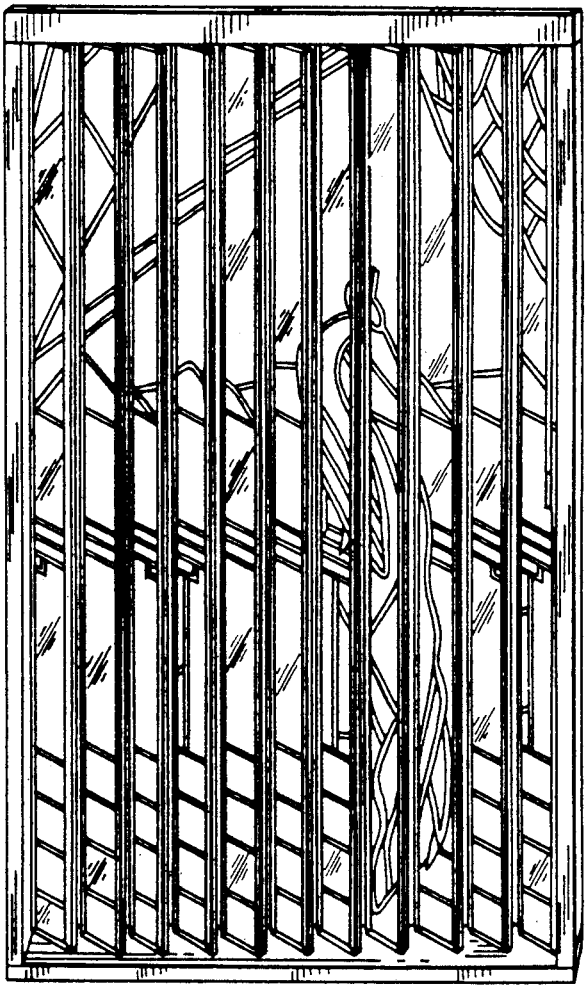
FIG. 7 is a front elevation view of the resulting window treatment illustrating the vanes in the pivoted position creating a three-dimensional effect.

As seen in FIGS. 5 and 6, each of the gear elements 30 meshes with sliding gear rack 44 mounted for longitudinal travel within the header 26. Such longitudinal travel, as depicted in FIG. 5, causes rotation of the clips 22 and accordingly pivots the attached vanes. Such pivoting action can change the appearance of the overall pattern 20 from that depicted in FIG. 4, in which the individual vanes all lie in the same plane, to the orientation depicted in FIG. 7, in which the vanes lie in parallel planes. Such an orientation can create a three-dimensional effect of the pattern upon the eyes of the viewer.

By use of the present invention, it is possible to achieve the look of a stained glass assemblage in conjunction with a standard window and further have the ability to both affect the look of the image, as well as the coverage of the window in a manner analogous to that of a conventional blind mechanism.

I claim:

1. A window blind comprising:

a plurality of vertical extending vanes, each of said vanes being formed of a transparent material, each of said vanes being pivotly mounted at its upper end to a horizontallyextending header and a plurality of individual colored glass-like elements being mounted to each of said vanes, each of said glass-like elements being surrounded by a border element, the overall arrangement of said elements upon said vanes creating a pre-selected design or pattern, said vanes being rotatable from a first position where they define a single plane to a second position where the vanes lie in parallel, vertically-extending planes.

2. The article of claim 1, wherein said border element is of lead-like appearance.

3. The article of claim 2, wherein said vane is formed of an acrylic plastic.

* * * * *